US008480424B2

(12) United States Patent
Koellmann

(10) Patent No.: US 8,480,424 B2
(45) Date of Patent: Jul. 9, 2013

(54) ELECTRICAL CONNECTING TERMINAL HAVING A LEVER WITH A SHAFT WITH A CLEARANCE FOR ACCOMMODATING A LUG OF A TENSION SPRING

(75) Inventor: Hans-Josef Koellmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 13/274,728

(22) Filed: Oct. 17, 2011

(65) Prior Publication Data

US 2013/0095688 A1 Apr. 18, 2013

(30) Foreign Application Priority Data

Oct. 19, 2010 (DE) ..... 10 2010 048 698

(51) Int. Cl.
*H01R 13/627* (2006.01)

(52) U.S. Cl.
USPC ..... 439/358

(58) Field of Classification Search
USPC ..... 439/441, 835, 864, 725, 157, 358
See application file for complete search history.

(56) References Cited

U.S. PATENT DOCUMENTS

| | | | | |
|---|---|---|---|---|
| 6,132,238 | A * | 10/2000 | Hartmann et al. | 439/439 |
| 6,280,233 | B1 * | 8/2001 | Beege et al. | 439/441 |
| 6,750,402 | B2 * | 6/2004 | Geske | 174/135 |
| 7,704,093 | B2 * | 4/2010 | Turkekole et al. | 439/395 |
| 8,129,641 | B2 * | 3/2012 | Majewski et al. | 200/335 |
| 8,137,145 | B2 * | 3/2012 | Joy | 439/864 |
| 2004/0077210 | A1 * | 4/2004 | Kollmann | 439/441 |
| 2008/0248699 | A1 * | 10/2008 | Schafer et al. | 439/729 |
| 2010/0173531 | A1 * | 7/2010 | Holste | 439/700 |

FOREIGN PATENT DOCUMENTS

| | | |
|---|---|---|
| DE | 198 05 945 Al | 7/1999 |
| DE | 299 11 124 U1 | 8/2000 |
| DE | 102 37 701 A1 | 2/2004 |
| DE | 20 2005 020 655 | 8/2006 |
| DE | 20 2007 001 701 | 7/2008 |
| DE | 10 2008 017 738 | 10/2008 |
| DE | 10 2007 026 999 | 12/2008 |
| JP | 9-63664 | 3/1997 |

* cited by examiner

*Primary Examiner* — Chandrika Prasad
(74) *Attorney, Agent, or Firm* — Renner, Otto, Boisselle & Sklar, LLP

(57) ABSTRACT

An electrical connecting terminal has an insulating material housing and at least one spring clamping connection in the housing. The spring clamping connection has a cage tension spring having a bearing limb which rests on a busbar section, a rear spring bow which adjoins the latter, and an operating limb. The operating limb has, on a clamping section which is bent around in the direction of the busbar section, a window cutout through which the busbar section is led and a lower crosspiece which forms a clamping point for clamping an electrical conductor between the crosspiece and the busbar section. A lug projects forward and outward from the operating limb opposite to the rear spring bow. Each spring clamping connection has an operating lever pivotably mounted in front of the clamping section of the operating limb of the cage tension spring and has a support oriented to rest on the lug.

7 Claims, 3 Drawing Sheets

ELECTRICAL CONNECTING TERMINAL HAVING A LEVER WITH A SHAFT WITH A CLEARANCE FOR ACCOMMODATING A LUG OF A TENSION SPRING

FIELD OF INVENTION

The invention relates to an electrical connecting terminal having an insulating material housing and having at least one spring clamping connection in the insulating material housing, the at least one spring clamping connection having a cage tension spring having a bearing limb which rests on a busbar section, a rear spring bow which adjoins the latter and an operating limb, the operating limb having, on a clamping section which is bent around in the direction of the busbar section, a window cutout through which the busbar section is led and the lower crosspiece of which forms a clamping point for clamping an electrical conductor between the crosspiece and the busbar section, and a lug projecting forward and outward away from the operating limb in the direction opposite to that of the rear spring bow.

BACKGROUND

Such electrical connecting terminals having an operating fever for a spring clamping connection are known in multifarious forms.

DE 10 2008 017 738 A1 shows an electrical connecting terminal having a cage tension spring which can be opened by an operating lever which is pivotably mounted in the insulating material housing. In this case, the operating lever is arranged above the cage tension spring and rests, with a contact surface which extends approximately from the height of the bearing pin to the free end on the underside of the operating lever, on the spring rear of the cage tension spring during pivoting of the operating lever. As a result, the cage rear is pressed downward and the cage tension spring is opened.

DE 20 2007 001 701 U1 discloses an electrical connecting terminal having a leg spring which has a cutout through which a lug of a busbar projects. The lower edge of the cutout forms, with the busbar, a clamping point for an electrical conductor which can be inserted into the insulating material housing through a conductor insertion opening and through the cutout. Pivotably arranged above the leg spring is an operating lever which acts on the upper peripheral edge, which delimits the cutout, at the free end of the leg spring. Upon pivoting of the operating lever which acts against the end of the clamping limb, the clamping point is opened.

DE 198 02 945 C2 discloses an electrical terminal having a cage tension spring which is mounted on a busbar. At the upper edge of a window cutout of the clamping limb of the clamping spring, a material tab is bent outward in such a manner that the material tab is a guide tab for the tip of an operating tool. When inserting a screwdriver as an operating tool in the direction of extent of the bearing limb of the clamping spring, the tip of the tool strikes this material tab, as a result of which the clamping limb of the clamping spring is pressed down with a gentle motion sequence with improved conversion of force from the feed motion of the operating tool for the purpose of opening the clamping point. The length of the lever arm is increased by the tip of the tool acting on the end of the material tab.

SUMMARY

On the basis of this, the object of the present invention is to provide an improved electrical connecting terminal having an operating lever, which terminal is compact and requires as little operating force as possible.

The object is achieved, with the electrical connecting terminal of the type mentioned at the outset, by virtue of the fact that each spring clamping connection has an operating lever which is pivotably mounted in front of the clamping section of the operating limb of the cage tension spring in a manner adjoining the lug and has a support which is oriented to rest on the lug (upon operation).

The operating lever is not arranged above the clamping spring, as known per se from the prior art. Rather, the pivot bearing is situated in front of the cage tension spring in a manner adjoining a lug which extends forward from the rear spring bow away from the operating limb. The operating lever then rests on the lug with a support in order to press the operating section downward when pivoting the operating lever in the direction of the busbar section. The size of the lever arm is increased and the required leverage is thus reduced as a result of the lug. The arrangement of the bearing in front of the cage tension spring adjoining the lug has the advantage that the connecting terminal can be designed to be very compact. In addition, the bearing pins of the operating lever are excessively stressed by the mounting of the operating lever in the insulating material housing in a manner adjoining the lug.

It is advantageous if the lug extends on a common plane with that section of the operating limb which adjoins the lug and extends in the direction of the spring bow, and that section of the operating section which is provided with the window cutout is bent out of this plane in the direction of the busbar section. This means that, during pivoting, the support of the operating lever can continuously roll on the supporting plane of the lug and of that section of the operating limb which adjoins the latter, without getting caught. In addition, the lever arm is optimized with respect to the spring bow as a result. This applies, in particular, when the lug and that section of the operating limb which adjoins the latter extend in the direction of the central region of the spring bow.

It is also advantageous if the operating lever with laterally protruding bearing pins is pivotably mounted in corresponding bearing hollows of the insulating material housing. The operating lever is thus held in a stable manner and is guided in a tilt-proof manner.

For this purpose, the operating lever should be integrally formed from a plastics material. The operating lever can thus be produced in an inexpensive manner and a stable configuration can be ensured. In this case, the operating lever has a lever arm and a bearing shaft which is partially surrounded by the underside of the lever arm in the region of an operating end of the operating lever. The fever arm thus engages over a bearing shaft in order to thus optimally convert the tilting moment acting on the lever arm into a rotational movement of the bearing shaft upon operation. Ends of the bearing shaft protrude from the lateral surfaces of the lever arm in order to form the laterally protruding bearing pins. A clearance for accommodating the lug of the cage tension spring is then provided underneath the lever arm in the bearing shaft. The upper wall of the clearance then forms the support for the lug. The leverage of the operating lever is thus transmitted to the lug of the cage tension spring in the region of the bearing shaft. As a result, the tilting moments acting on the bearing pin and the adjoining insulating material housing of the connecting terminal are kept as low as possible.

The support for the lug preferably changes, on the underside of the operating lever, into a curved section which extends from a free operating end of the operating lever to that top side of the operating fever which adjoins the free operating end. During pivoting of the operating lever, the lug and the adjoining section of the operating limb thus slide on the curved section with the least possible friction at the free operating end.

The electrical connecting terminal may be, for example, a plug-in connector having a plurality of spring clamping connections. In this case, each spring clamping connection may have its own busbar. It is advantageous in this case if the busbar has, on a side of the insulating material housing facing away from the conductor insertion opening that leads to the respective spring damping connection in the insulating material housing, a plug-in connection for a mating plug-in connector. Individual conductors can thus be connected to associated spring clamping connections from one side of the connecting terminal. A mating plug-in connector can then be attached to associated plug-in connections on the opposite side or on at least one angled top side/underside of the plug-in connector in order to provide a releasable electrical connection. However, it is also conceivable for the plug-in connection to be in the form of a soldering connection for printed circuit boards.

In another embodiment, an electrical connecting terminal having a plurality of spring clamping connections may have a common busbar for connecting the plurality of spring clamping connections. A plurality of busbar sections for associated spring clamping connections are then present on the common busbar. In this context, a variant in which an electrical connecting terminal has two or more busbars, which are separate from one another and each have one or more busbar sections for associated spring damping connections, is also conceivable.

DESCRIPTION OF THE DRAWINGS

The invention is explained in more detail below using the accompanying drawings, in which:

FIG. 1 reveals an electrical connecting terminal 1 having an insulating material housing 2. Spring clamping connections each with a cage tension spring 3 and a busbar section 4 are formed in the insulating material housing 2. In a manner known per se, the cage tension spring 3 has a bearing limb 5 which rests on the busbar section 4 and is adjoined by a spring bow 6. An operating limb 7 extends back from the spring bow 6 again, with the result that the cage tension spring 3 is bent in an approximately U-shaped manner in this region. The operating limb 7 is then angled in the direction of the busbar section 4 and the bearing limb 5 and has, in this region, a window cutout 8 through which the busbar section 4 and optionally also part of the bearing limb 5 are guided. Underneath the busbar section 4, the window cutout 8 is delimited by a crosspiece 9 which forms a clamping point for clamping an electrical conductor between the crosspiece 9 and the busbar section 4.

DETAILED DESCRIPTION

Figure 1:
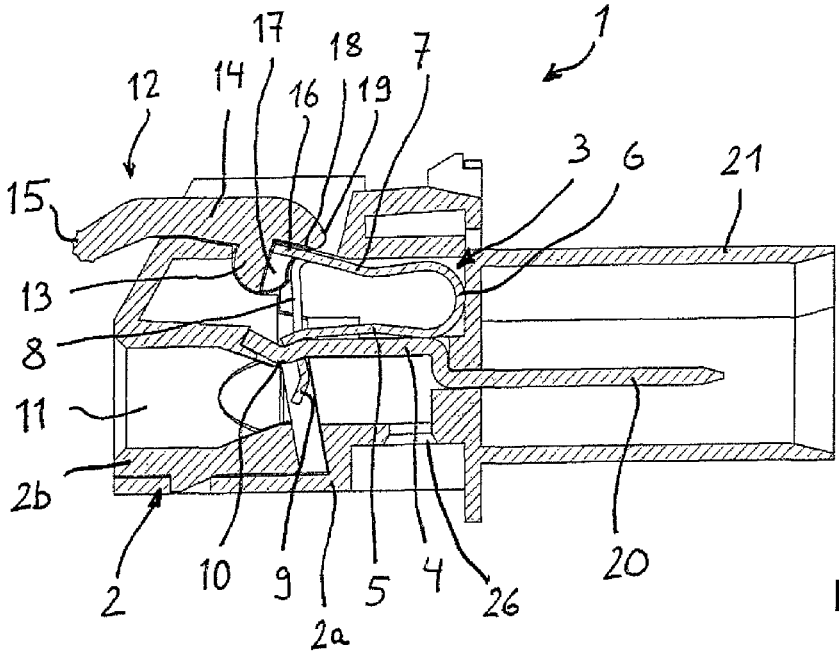
FIG. 1—shows a side sectional view of an electrical connecting terminal with a closed spring clamping connection.

In order to ensure that the electrical conductor rests on the busbar section 4 as far as possible in punctiform fashion and with the smallest possible support surface for the electrical conductor, a protrusion 10 is provided on the busbar section 4 and adjoins the crosspiece 9 when not clamped. The clamping force of the cage tension spring 3 is thus concentrated on this protrusion 10, thus achieving a high surface pressure.

An electrical conductor is inserted into the insulating material housing 2 through a conductor insertion opening 11 on the front side of the insulating material housing and is guided below the busbar section 4 in order to be positioned between the busbar section 4 and the crosspiece 9.

In order to be able to clamp such an electrical conductor, the cage tension spring 3 must first of all be operated once by pressing the upper part of the operating limb 7 downward in the direction of the busbar section 4 and the bearing limb 5. An operating lever 12 which is pivotably mounted with bearing pins on a bearing shaft 13 in the insulating material housing 2 is used for this purpose.

The operating lever 12 has a lever arm 14 with a free end 15 which can be gripped by the user in order to pivot the operating lever 12. Underneath the lever arm opposite the free end 15, the bearing shaft 13 is integrally formed with the lever arm 14. In this manner, the operating lever 12 is integrally formed from an insulating plastics material, for example.

In order to increase the size of the lever arm when operating the cage tension spring 3, a lug 16 projects from that section of the operating limb 7 which adjoins the spring bow 6 and is not bent in the direction of the busbar section 4 and the bearing limb 5. The operating lever 12 now acts on this protruding lug during opening (in order to operate) the cage tension spring 3, as a result of which the size of the fever arm is increased between the point at which the operating lever 12 acts on the cage tension spring 3 and the central region of the spring bow 6 in comparison with the cage tension spring 3 acting on the operating limb 7 closer to the spring bow 6 in a section between the bend of the operating limb and the spring bow 6.

The lug 16 is accommodated in a clearance 17 of the operating lever 12. The clearance is provided by a cutout in the bearing shaft 13, the top side of the clearance being used as a support 18 for the lug 16.

It can be seen that the support 18 for the lug 16 changes, on the underside of the operating lever 12, into a curved section 19 which extends from a free operating end of the operating lever 12 to the top side of the operating lever 12 which adjoins the free operating end.

The free operating end is opposite the free end 15 of the operating lever 12 in this case.

The insulating material housing 2 illustrated has a two-part construction. The cage tension spring 3 is inserted, together with the busbar section 4, into a first part 2*a* of the insulating material housing 2. After the operating lever 12 has been inserted, the insulating material housing 2 is completed by pushing on and latching a second part 2*b*. The pivot mounting for the operating lever 12 is achieved using the first and second parts 2*a*, 2*b*.

In the embodiment illustrated, the electrical connecting terminal 1 is in the form of a plug-in connector. In this case, each spring clamping connection has its own busbar which has a plug-in connection 20 for receiving a mating plug-in connector on the side facing away from the spring clamping connection with the conductor insertion opening 11. The plug-in connection formed from the busbar section 4 can be surrounded in this case by a guide and protective wall 21 made of the material of the insulating material housing in order to provide a connector with a predefined contour for accommodating a corresponding mating connector.

It is of course also conceivable for the plug-in connection 20 to be angled and to project upward or downward. A variant in which the plug-in connection 20 formed from the busbar section 4 is in the form of a soldering pin or soldering pad in order to solder the connecting terminal to a printed circuit board is also possible. The guide and protective wall 21 would then not be present.

An inspection and test opening 26 in the insulating material housing 2 makes it possible to access the conductor end 22 in order to be able to visually check whether the conductor end 22 has been correctly and completely inserted. In addition, the inspection and test opening 26 can be used to test for the presence of an electrical voltage.

Figure 2:
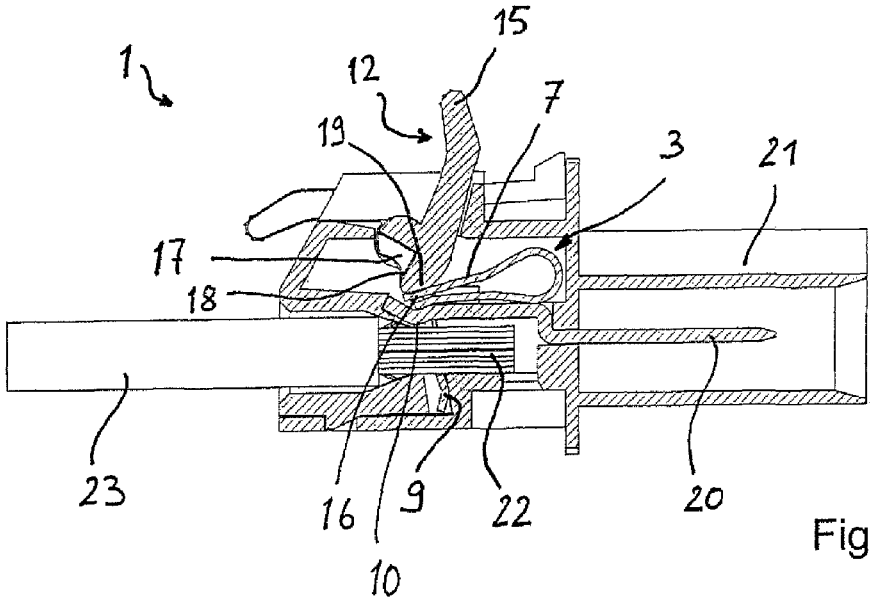
FIG. 2—shows the side sectional view from FIG. 1 with an open spring clamping connection and an inserted electrical conductor.

FIG. 2 reveals a side sectional view of the connecting terminal 1 from FIG. 1 with an operated cage tension spring 3. It becomes clear that the operating lever 12 is pivoted upward in the clockwise direction. The curved section 19 now rests, with that top side of the operating lever 12 which adjoins the free operating end, on the lug 16 which projects from the operating limb 7. As a result, the cage tension spring 3 is opened such that the crosspiece 9 is guided downward out of the conductor insertion opening. That end 22 of an electrical conductor 23 from which the insulation has been stripped can thus be guided through the window cutout 8 beneath the busbar section 4. The cage tension spring 3 is released when the operating lever 12 is pivoted back, with the result that that end 22 of the electrical conductor 23 from which the insulation has been stripped is clamped between the crosspiece 9 and the protrusion 10 of the busbar section 4 as a result of the force of the cage tension spring 3.

Figure 3:
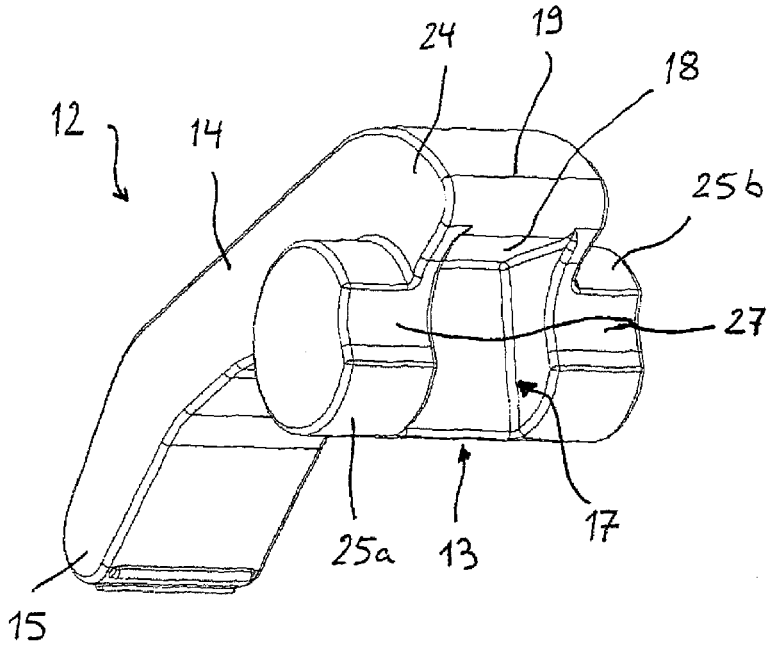
FIG. 3—shows a perspective rear view of an operating lever of the connecting terminal from FIG. 1.

FIG. 3 reveals a perspective view of the operating lever 12 from the rear side. It becomes clear that the bearing shaft 13 is integrally formed with the lever arm 14 at the free operating end 24 of the operating lever 12 which is opposite the free end 15 which protrudes forward. In this case, the bearing shaft 13 is arranged on the underside of the fever arm 14 and has the clearance 17 (already mentioned). The bearing shaft 13 is so long that bearing pins 25*a*, 25*b* which enter corresponding bearing hollows of the insulating material housing 2 protrude from the lateral surfaces of the lever arm 14. A support 18 for resting on the lug 16 of the cage tension spring 3 is arranged on the top side of the clearance 17. The support 18 changes into a curved section 19 which rolls on the lug 16 during pivoting of the operating lever 12.

Hollows 27, by means of which the operating lever 12 can be placed as close as possible to the cage tension spring 3 without collision in order to save installation space, can be made in the bearing pins 25*a*, 25*b*.

Figure 4:
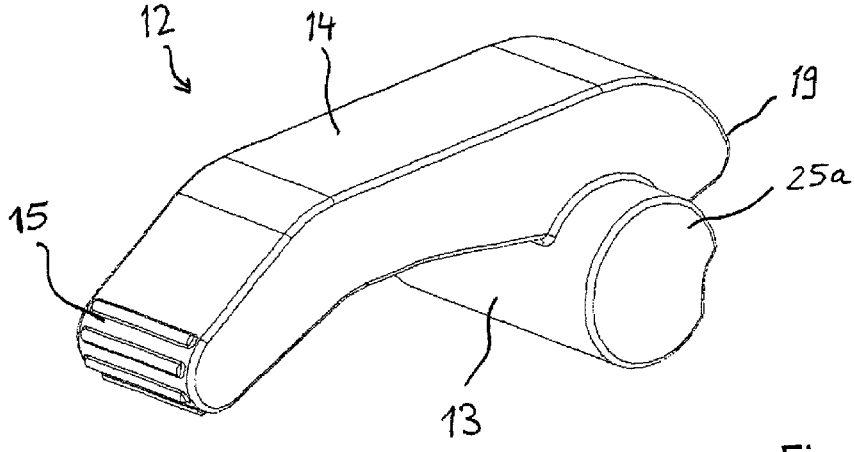
FIG. 4—shows a perspective side view of the operating lever from FIG. 3.

FIG. 4 again reveals a perspective view of the operating lever 12. It becomes clear that the bearing shaft 13 is integrally formed with the lever arm 14 from an insulating plastics material on the underside of the lever arm 14.

Figure 5:
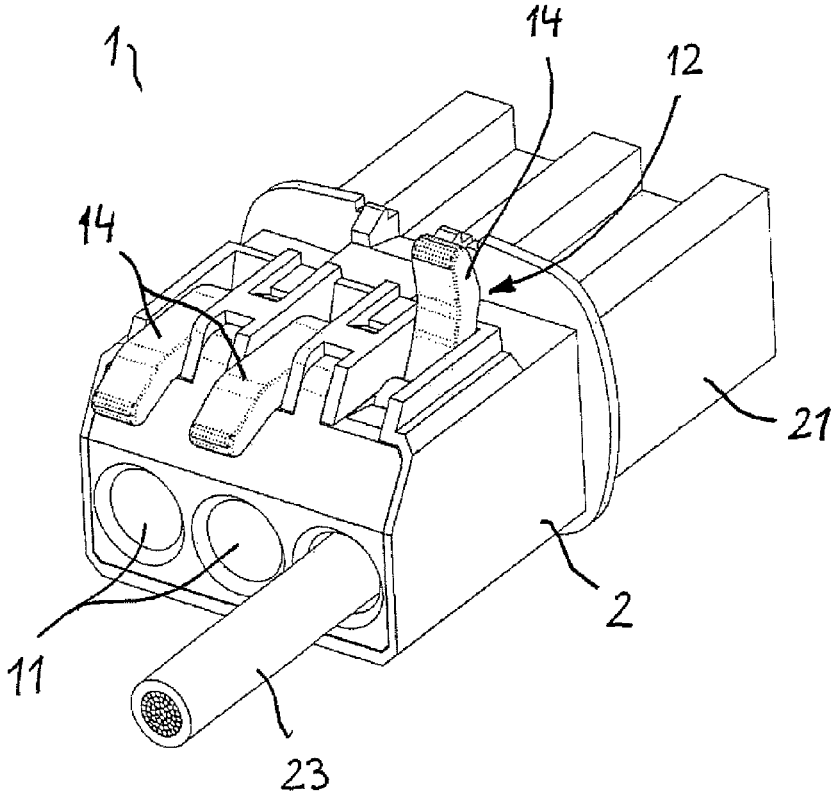
FIG. 5—shows a perspective view of the electrical connecting terminal from FIG. 2.

FIG. 5 reveals a perspective view of a connecting terminal with three spring clamping connections. It becomes clear that that end of the electrical conductor 23 from which the insulation has been stripped is inserted into a conductor insertion opening 11 on the front side of the connecting terminal 1. The cage tension spring 3 is opened (cf. FIG. 2) by pivoting up the operating lever 12, with the result that the electrical conductor 23 can be inserted into the spring clamping connection and can be clamped there.

It also becomes clear that a plug-in connection area for attaching a mating plug-in connector is provided opposite the spring clamping connections with the conductor insertion openings 11. For this purpose, the insulating material housing is designed, in this region, with a corresponding guide and protective wall 21 having a contour which matches a mating plug-in connector.

The invention claimed is:

1. An electrical connecting terminal comprising:

an insulating material housing and having at least one spring clamping connection in the insulating material housing, the at least one spring clamping connection having a cage tension spring having a bearing limb which rests on a busbar section;

a rear spring bow which adjoins the bearing limb; and an operating limb adjoined by the rear spring bow and the bearing limb, the operating limb having:

a clamping section which is bent around in the direction of the busbar section;

a window cutout delimited by a lower crosspiece, wherein the busbar section is led through the window cutout and the lower crosspiece forms a clamping point for clamping an electrical conductor between the crosspiece and the busbar section; and a lug projecting forward and outward away from the operating limb in the direction opposite to that of the rear spring bow, wherein each spring clamping connection has an operating lever which is pivotably mounted in front of the clamping section of the operating limb of the cage tension spring in a manner adjoining the lug and has a support which is oriented to rest on the lug, and wherein each operating lever has a lever arm, a bearing shaft, and a clearance for accommodating the lug of the cage tension spring being underneath the lever arm in the bearing shaft.

2. The electrical connecting terminal as claimed in claim 1, wherein the lug extends on a common plane with that section of the operating limb which adjoins the lug and extends in the direction of the spring bow, and that section of the operating section which is provided with the window cutout is bent out of this plane in the direction of the busbar section.

3. The electrical connecting terminal as claimed in claim 1, wherein the operating lever with laterally protruding bearing pins is pivotably mounted in corresponding bearing hollows of the insulating material housing.

4. The electrical connecting terminal as claimed in claim 3, wherein the operating lever is integrally formed from a plastics material and the bearing shaft is partially surrounded by the underside of the lever arm in the region of an operating end of the operating lever, the ends of said bearing shaft protrude from the lateral surfaces of the lever arm forming the laterally protruding bearing pins.

5. The electrical connecting terminal as claimed in claim 1, wherein the support for the lug changes, on the underside of the operating lever, into a curved section which extends from a free operating end of the operating lever to that top side of the operating lever which adjoins the free operating end.

6. The electrical connecting terminal as claimed in claim 1, wherein the electrical connecting terminal is in the form of a plug-in connector having a plurality of spring clamping connections, wherein each spring clamping connection has its own busbar, and the busbar has, on a side facing away from the conductor insertion opening that leads to the respective spring clamping connection in the insulating material housing, a plug-in connection for a mating plug-in connector or soldering connections for printed circuit boards.

7. The electrical connecting terminal as claimed in claim 1 further comprising:

a plurality of spring clamping connections, wherein a plurality of spring clamping connections have a common busbar on which the busbar sections for the spring clamping connections are formed.

* * * * *